US007137912B2

(12) United States Patent
Ashino et al.

(10) Patent No.: US 7,137,912 B2
(45) Date of Patent: Nov. 21, 2006

(54) TENNIS RACKET

(75) Inventors: Takeshi Ashino, Hyogo (JP); Kunio Niwa, Hyogo (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/135,379

(22) Filed: May 24, 2005

(65) Prior Publication Data

US 2005/0266941 A1 Dec. 1, 2005

(30) Foreign Application Priority Data

May 25, 2004 (JP) ..... 2004-155149

(51) Int. Cl.
*A63B 49/02* (2006.01)

(52) U.S. Cl. ..... 473/537; 473/535

(58) Field of Classification Search ..... 473/535–537, 473/524

See application file for complete search history.

(56) References Cited

U.S. PATENT DOCUMENTS 5,165,687 A * 11/1992 Soong ..... 473/521
5,368,297 A * 11/1994 Liu ..... 473/539
6,293,878 B1 * 9/2001 Iwatsubo et al. ..... 473/521
6,530,851 B1 * 3/2003 Munster ..... 473/521
6,623,383 B1 * 9/2003 Matsuoka et al. ..... 473/519
2002/0058557 A1 * 5/2002 Kanemitsu ..... 473/520
2005/0192128 A1 * 9/2005 Takeuchi et al. ..... 473/520
2005/0266941 A1 * 12/2005 Ashino et al. ..... 473/535

FOREIGN PATENT DOCUMENTS

JP 10-328333 A 12/1998
JP 2001-145711 A 5/2001
JP 2002-113131 A 4/2002
JP 2003-175134 A 6/2003

* cited by examiner

*Primary Examiner*—Raleigh Chiu
(74) *Attorney, Agent, or Firm*—Birch Stewart Kolasch & Birch, LLP

(57) ABSTRACT

In a tennis racket having a racket frame composed of a fiber reinforced resin, the moment of inertia Ic of the tennis racket in a center direction thereof is set to not less than 13000 $g \cdot cm^2$ nor more than 17000 $g \cdot cm^2$, the moment of inertia Ig around a center of gravity thereof is set to not less than 80000 $g \cdot cm^2$ nor more than 200000 $g \cdot cm^2$, and the moments of inertia Ic and Ig are so set as to satisfy a relationship expressed by $[30 \times (Ic) - (Ig)]/10000 \geqq 31$.

7 Claims, 6 Drawing Sheets

PRIOR ART

TENNIS RACKET

This Nonprovisional application claims priority under 35 U.S.C. § 119(a) on Patent Application No(s). 2004-155149 filed in Japan on May 25, 2004, the entire contents of which are hereby incorporated by reference.

BACKGROUND OF THE INVENTION

The present invention relates to a tennis racket. More particularly, the present invention relates to a tennis racket having three functions in a favorable balance. That is, the present invention relates to a tennis racket which can be swung easily, has a high stability in its ball-hitting face owing to a low extent of deviation of the ball-hitting face, and has a high rebound performance.

The performance demanded for the tennis racket is a high operability (swinging motion), a high rebound performance, and a high stability in the ball-hitting face owing to a low extent of deviation of the ball-hitting face. To enhance these performances, a large number of proposals relating to the tennis racket designed by giving attention to the moment of inertia has been made.

For example, the present applicant proposed a tennis racket disclosed in Japanese Patent Application Laid-Open No. 2003-175134 (patent document 1). The racket frame is lightweight. The racket frame has a weight not less than 100 g nor more than 280 g. The rigidity value of the racket frame is set to a required range. The range of the moment of inertia thereof in the swing direction and the center direction thereof and the ratio therebetween are specified to thereby improve the operability and the ball-hitting face stability of the tennis racket.

More specifically, as shown in FIG. 8A, the moment of inertia (Is) of the racket frame in the swing direction around the grip end is set to not less than 440,000 $g \cdot cm^2$ nor more than 520,000 $g \cdot cm^2$. As shown in FIG. 8A, the moment of inertia Ic of the racket frame in the center direction thereof around the major axis thereof is set to not less than 13500 $g \cdot cm^2$ nor more than 17000 $g \cdot cm^2$. The ratio of the moment of inertia (Is) of the racket frame in the swing direction to the moment of inertia Ic thereof in the center direction thereof is set to not less than 28 nor more than 36.

However, in the racket frame shown in the patent document 1, optimization of the moment of inertia in conformity with the motion of the tennis racket is not made. Therefore the racket frame is incapable of making a dramatic improvement in its operability and has room for improvement.

In the racket frame disclosed in Japanese Patent Application Laid-Open No. 10-328333 (patent document 2), the emphasis is put on the operability thereof by allowing it to be swung easily. The racket frame is characterized in that the density of the fiber reinforced synthetic resin disposed in the vicinity of its center of gravity is set higher than the densities thereof disposed at other portions. This is to make the weight of the portion of the racket frame in the vicinity of its center of gravity heavy and its top portion lightweight so that the tennis racket can be swung easily and thus operated favorably.

In addition, the moment of inertia of the racket frame in the swing direction around the position (balance point) spaced by 50 mm from its grip end is set to a small value, namely, not less than 360 to 400 $g \cdot cm^2$ $S^2$ to enhance its operability.

In the racket frame of the patent document 2, it is possible to make the top portion thereof lightweight by increasing the density of the portion in the vicinity of its center of gravity.

But the amount of fiber and resin distributed to the head part surrounding the ball-hitting face is small. Thereby the head part has a low strength. Consequently the racket frame has a low rebound performance, and in addition a low stability in the ball-hitting face thereof. Therefore the racket frame is inferior in the balance among the rebound performance, operability, and controllability.

In the racket frame disclosed in Japanese Patent Application Laid-Open No. 2001-145711 (patent document 3), the portion of the racket frame at the head part surrounding the ball-hitting face is charged with the foamed material to increase the moment of inertia of the racket frame in the swing direction so that the rebound performance can be improved without increasing the weight of the racket frame too much.

The moment of inertia in the swing direction around the grip end is set to the range of $36 \times 10^3$ to $41 \times 10^3$ $kg \cdot m^2$ (360000 to 410000 $kg \cdot m^2$).

In the racket frame of the patent document 3, the weight concentrates on the head part surrounding the ball-hitting face. Consequently the moment of inertia of the racket frame in the swing direction is so large that it has a low operability.

The racket frame disclosed in Japanese Patent Publication No. 3369543 (patent document 4) has a weight of 150 to 200 g which is very lightweight and is so designed that the moment of inertia Ix in the swing direction around the position spaced by 80 mm from the grip end is set to the range of 0.018 $kg \cdot m^2$ to 0.0218 $kg \cdot m^2$ (180000 to 230000 $g \cdot m^2$) and that the moment of inertia Iy around the longitudinal axis of the tennis racket is set to not less than 0.032 times and less than 0.040 times the moment of inertia Ix in the swing direction. That is, the moment of inertia Iy is set to the range of 6300 to 10350 $g \cdot m^2$.

The moment of inertia of the racket frame in the swing and center directions thereof and the ratio therebetween are set to a specific range respectively to improve the operability and stability in the ball-hitting face of the racket frame.

The racket frame of the patent document 4 has a weight of 150 g to 200 g. According to the law of energy conservation, as the weight of the racket frame becomes lighter, the racket frame has an increasingly low coefficient of restitution in a collision between the racket frame and a ball and has a low rebound performance.

Patent document 1: Japanese Patent Application Laid-Open No. 2003-175134

Patent document 2: Japanese Patent Application Laid-Open No. 10-328333

Patent document 3: Japanese Patent Application Laid-Open No. 2001-145711

Patent document 4: Patent 3369543

The above-described conventional tennis rackets designed by paying attention to the moment of inertia can be swung easily or has a high rebound performance. But a tennis racket capable of performing all of the three functions in a favorable balance has not been provided. More specifically, a tennis racket that can be swung easily, has a high rebound performance, and has a high stability in its ball-hitting face in a favorable balance has not been provided.

SUMMARY OF THE INVENTION

To overcome the above-described problem, the present inventors have given attention to the moment of inertia of a tennis racket and completed the present invention. Therefore, it is an object of the present invention to provide a tennis racket which can be swung easily (high operability), has a high rebound performance, and has a high controllability of a ball-hitting face owing to the stability thereof in a favorable balance.

As disclosed in the specification of the patent document 1, the above-described conventional tennis rackets are designed by giving attention to the moment of inertia thereof around the grip end in the swing direction, as shown in FIG. 8A.

The present inventors have made researches on the moment of inertia of the tennis racket in the swing direction by repeating ball-hitting tests. As a result of the analysis of players' swings, the present inventors have found that a translation motion contributes to the motion of the tennis racket to a higher extent than a rotational motion thereof and that the moment of inertia of the tennis racket around the center of gravity (balance point) affects the translation motion greatly.

The present inventors analyzed the moment of inertia Ic of the tennis racket in the center direction thereof and the moment of inertia Ig thereof around the center of gravity (balance point) and the relationship therebetween. As shown in FIG. 1 in which the moments of inertia Ic and Ig are plotted, every conventional tennis racket are located in a region C of FIG. 1. As shown in FIG. 1, as the moment of inertia Ic thereof in the center direction becomes larger, the moment of inertia Ig thereof around the center of gravity thereof becomes increasingly large.

This is attributed to the fact described below. To increase the moment of inertia Ic of the tennis racket in the center direction thereof, the weight of the widest portion (region between 3 o'clock and 9 o'clock, supposing that the ball-hitting face is regarded as clock surface and that top position thereof is 12 o'clock) in the head part is increased. Thus the position of the center of gravity in the longitudinal direction of the tennis racket is distant from the grip end. Consequently the moment of inertia Ig thereof around the center of gravity becomes large.

As the moment of inertia Ic thereof in the center direction thereof becomes larger, the moment of inertia Ig thereof around the center of gravity becomes increasingly large, as described above. As a result, the top portion of the head part is heavy. Thereby there arise a problem that the operability of the tennis racket deteriorates because a player has difficulty in swinging it and a problem that it is difficult to adjust the ball-hitting face instantaneously.

To overcome these problems, in the present invention, the moment of inertia Ic of the tennis racket in the center direction thereof is set large, whereas the moment of inertia Ig thereof around the center of gravity is set small. The range of each of the moments of inertia Ic and Ig set in the present invention is different from the range of those of the conventional tennis racket. The ratio between the moments of inertia Ic and Ig is also set. Thereby the operability (swinging motion) of the tennis racket, the controllability of the ball-hitting face thereof owing to stability thereof, and the rebound performance thereof are improved in an optimum balance.

More specifically, the present invention provides a tennis racket having a racket frame composed of a fiber reinforced resin, in which the moment of inertia Ic of the tennis racket in a center direction thereof is set to not less than 13000 $g \cdot cm^2$ nor more than 17000 $g \cdot cm^2$; the moment of inertia Ig thereof around a center of gravity thereof is set to not less than 80000 $g \cdot cm^2$ nor more than 200000 $g \cdot cm^2$; and the moments of inertia Ic and Ig are so set as to satisfy a relationship expressed by $[30 \times (Ic) - (Ig)]/10000 \geqq 31$.

The moment of inertia Ic of the tennis racket in the center direction means the moment of inertia around the longitudinal axis thereof, similarly to the conventional art.

The conventional tennis racket is designed based on the moment of inertia around the grip end in the swing direction. On the other hand, the tennis racket of the present invention is designed based on the moment of inertia around the center of gravity (balance point) thereof.

Although the position of the center of gravity of the tennis racket varies according to a tennis racket, the position of the center of gravity thereof is set to the range of 300 mm to 400 mm from the grip end in ordinary tennis rackets except a particular tennis racket.

The rotation moment of inertia of the tennis racket in the swing direction is set around the grip end in the patent documents 1 and 3, around the position spaced by 50 mm from the grip end in the patent document 2, and around the position spaced by 80 mm from the grip end in the patent document 4. In the present invention, the rotation moment of inertia in the swing direction is set around the position of the center of gravity spaced in the range of 300 to 400 mm from the grip end.

As described above, in the present invention, the tennis racket is designed based on the moment of inertia concerned in the translation motion of the tennis racket which occurs during play to enhance the operability (swinging motion), controllability of the ball-hitting face owing to stability thereof, and rebound performance of the tennis racket in a favorable balance.

The position of the center of gravity of the tennis racket and the moments of inertia Ic and Ig thereof are specified in a state in which a grommet, a bumper, an end cap, and grip leather are mounted thereon but strings are not mounted thereon.

As described above, the moment of inertia Ic of the tennis racket in the center direction thereof is set to not less than 13000 $g \cdot cm^2$ nor more than 17000 $g \cdot cm^2$.

The stability of the ball-hitting face of the racket frame can be enhanced by setting making the moment of inertia thereof around the grip in the center direction thereof by setting it to the above-described range. Thereby it is possible to suppress the deviation of the ball-hitting face to a low extent.

That is, when the moment of inertia Ic of the tennis racket in the center direction thereof is less than 13000 $g \cdot cm^2$, the ball-hitting face deviation occurs in an off-center region of the racket frame to a high extent and thereby controllability of the ball-hitting face deteriorates. Therefore the moment of inertia Ic of the tennis racket in the center direction thereof is more favorably not less than 13500 $g \cdot cm^2$ and most favorably not less than 15000 $g \cdot cm^2$.

When the moment of inertia Ic of the tennis racket in the center direction thereof is more than 17000 $g \cdot cm^2$, it is possible to suppress the ball-hitting face deviation in the off-center region. But the tennis racket is so heavy that the operability thereof deteriorates. Thus the moment of inertia Ic of the tennis racket in the center direction thereof is more favorably not more than 168000 $g \cdot cm^2$.

As described above, the moment of inertia Ig of the tennis racket around the center of gravity thereof is set small, namely, not less than 80000 $g \cdot cm^2$ nor more than 200000 $g \cdot cm^2$.

The racket frame can be swung easily by setting the moment of inertia Ig of the tennis racket around the center of gravity thereof to the above-described range.

If the moment of inertia of the tennis racket around the center of gravity thereof is less than 80000 $g \cdot cm^2$, the head part has a small weight and has a low rebound performance. Thus the moment of inertia of the tennis racket around the center of gravity thereof is more favorably not less than 87000 g·cm$^2$.

If the moment of inertia of the tennis racket around the center of gravity thereof is more than 200000 g·cm$^2$, the top side of the head part is so heavy that the operability of the tennis racket deteriorates. Therefore the moment of inertia of the tennis racket around the center of gravity thereof is more favorably not more than 182000 g·cm$^2$, and most favorably not more than 140000 g·cm$^2$.

The moment of inertia Ig of the tennis racket around the center of gravity thereof is set to the above-described range, although the distance from the grip end to the center of gravity is different in dependence on a tennis racket. The position of the center of gravity of ordinary tennis rackets is in the range of 300 to 400 mm from the grip end. When the position of the center of gravity of the tennis racket is in this range, the moment of inertia Ig thereof around the center of gravity is set to the above-described range.

As described above, the moments of inertia Ic and Ig have the relationship expressed by $[30\times(Ic)-(Ig)]/10000 \geqq 31$.

When the relationship expressed by $[30\times(Ic)-(Ig)]/10000$ is less than 31, it is difficult to improve the operability, ball-hitting face stability, and the rebound performance of the tennis racket in a favorable balance.

The relationship expressed by $[30\times(Ic)-(Ig)]/10000$ is more favorably not less than 37 and most favorably not less than 42.

That is, it is favorable that the moment of inertia Ic of the tennis racket in the center direction thereof is set to not less than 15000 g·cm$^2$ nor more than 17000 g·cm$^2$, that the moment of inertia Ig of the tennis racket around the center of gravity (balance point) thereof is set to not less than 80000 g·cm$^2$ nor more than 140000 g·cm$^2$, and that the moments of inertia Ic and Ig have the relationship expressed by $[30\times(Ic)-(Ig)]/10000 \geqq 37$.

As described above, it is preferable that the moment of inertia Ic of the tennis racket in the center direction thereof is large and that the moment of inertia Ig thereof around the center of gravity thereof is small. The tennis racket of the present invention has an optimum weight balance so that the moments of inertia Ic and Ig satisfy the above-described relationship.

To make the moment of inertia of the tennis racket in the center direction thereof large, any of the following methods can be selectively used or in combination:

(a) Fibers or resins having a large specific gravity are layered one upon another at a position distant from the longitudinal axis of the racket frame. Alternatively a weighty material having a large specific gravity is mounted thereat.

More specifically, glass fibers having a large specific gravity (for example, 2.2 to 3.2) are disposed thereat collectively.

(b) The ball-hitting face in which strings are tensionally mounted is configured in conformity to the configuration of the head part.

(c) The width of a sectional surface of the racket frame parallel with the ball-hitting face is increased.

(d) A material (fiber or resin) having a high specific gravity is disposed on the outer side (side of racket frame where groove for string is disposed) of the head part of the racket frame.

To make the moment of inertia Ig of the tennis racket around the center of gravity small, any of the following methods can be selectively adopted or in combination:

(e) A weight is concentrated in the vicinity of the center of gravity (balance point).

(f) The top side (12 o'clock of ball-hitting face) and grip part of the racket frame are made lightweight.

To this end, a bumper grommet to be mounted on the racket frame and an end cap to be mounted on the grip part are made lightweight.

(g) The portion of the head part between the five o'clock position and the seven o'clock position is made widest. That is, the width of the portion near the center of gravity is made largest.

In the tennis racket of the present invention, even though the weight of the racket frame is set to not less than 250 g to prevent the deterioration of the rebound performance thereof, the tennis racket is so constructed that a player can be swung it easily. Therefore even a powerless player can swing it easily.

The present invention can be suitably used for a tennis racket whose racket frame has a weight not less than 250 g nor more than 380 g and favorably not less than 280 g nor more than 350 g.

The whole length of the tennis racket of the present invention is set to the range from 673 mm to 706 mm. The dimension (balance point) between the center of gravity of the tennis racket and the grip end is set to 300 to 400 mm and favorably 320 to 365 mm. The area of the ball-hitting face of the tennis racket is set to the range of 61290 mm$^2$ (95 square inches) to 83871 mm$^2$ (130 square inches).

The present invention is preferably applicable to a tennis racket whose frame consists of a pipe composed of a laminate of fiber reinforced prepregs and has the grip part, the shaft part, the throat part, and the head part formed continuously with one another.

It is preferable that the above-described fiber reinforced prepreg contains a thermosetting resin (epoxy resin) and carbon fibers, used as its reinforcing fiber, which are impregnated with the thermosetting resin. As the reinforcing fiber, it is possible to use an aramid fiber, a boron fiber, an aromatic polyamide fiber, an aromatic polyester fiber, and an ultra-high-molecular-weight polyethylene in addition to the carbon fiber.

In addition to the racket frame composed of the laminate of the fiber reinforced prepregs, the present invention is applicable to a racket frame formed by charging a layup formed by winding reinforcing fibers around a mandrel by a filament winding method with a thermoplastic resin such as rim nylon.

As apparent from the foregoing description, the distribution of the weight of the racket frame and the configuration thereof is optimized to increase the moment of inertia in the center direction so that the ball-hitting face does not deviate and decrease the moment of inertia around the center of gravity so that the tennis racket can be swung easily. Thereby even though the weight of the racket frame is 250 g or more, the tennis racket can be swung easily for a long time and thereby its rebound performance can be enhanced.

Apparently the tennis racket of the present invention has improved operability (swinging motion), rebound performance, and the stability of the ball-hitting face (deviation of ball-hitting face does not occur) in a favorable balance.

DETAILED DESCRIPTION OF THE PREFERRED EMBODIMENTS

The embodiments of the present invention will be described below with reference to the drawings.

Figure 2A:
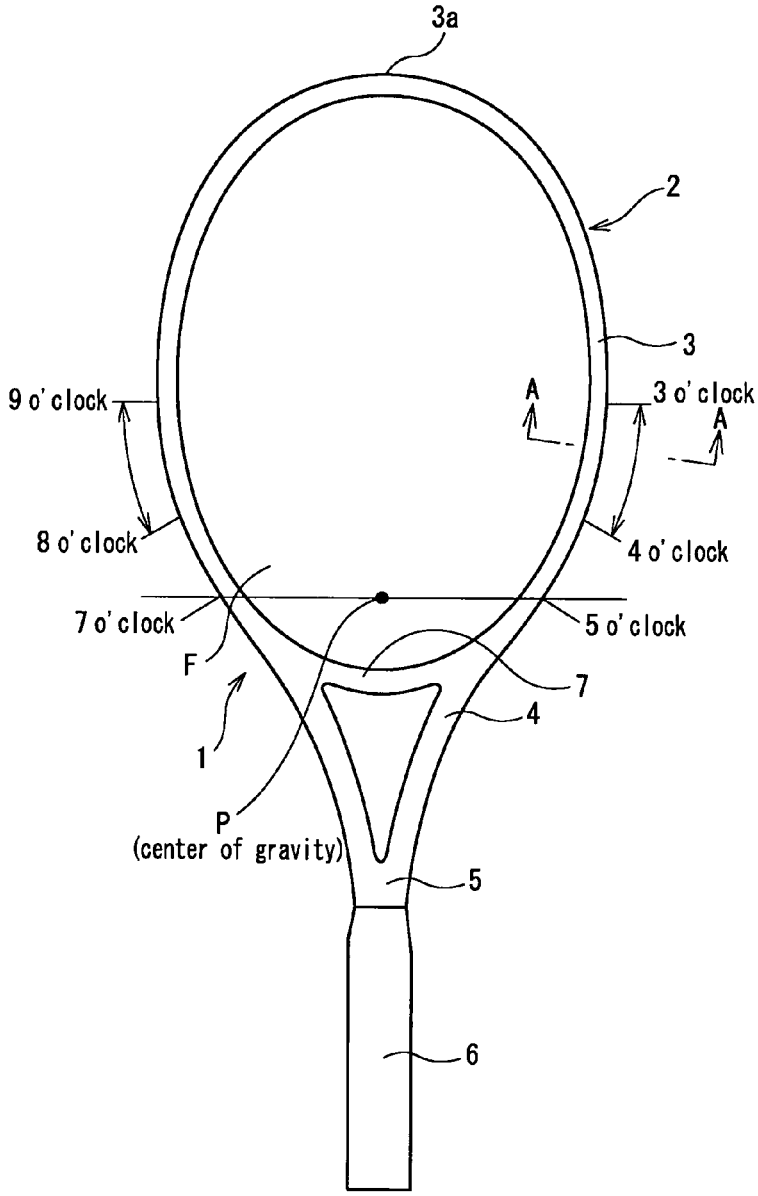
FIG. 2A is a plan view showing the racket frame of the tennis racket of an embodiment of the present invention.
Figure 2B:
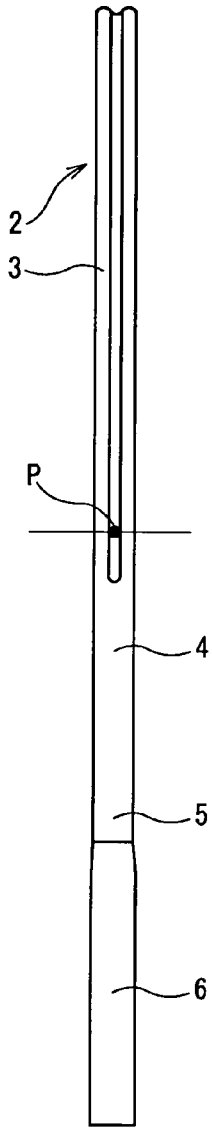
FIG. 2B is a front view showing the racket frame of the tennis racket of the embodiment of the present invention.
Figure 3:
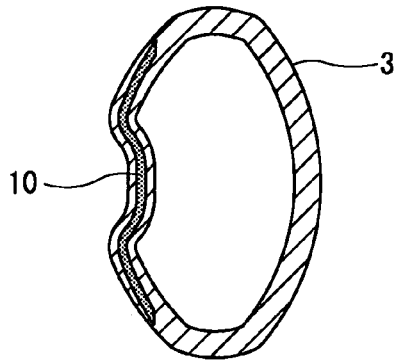
FIG. 3 is a sectional view taken along a line in FIG. 2.

A racket frame 2 of a tennis racket 1 shown in FIGS. 2 through 4 includes a head part 3 surrounding a ball-hitting face F, a throat part 4, a shaft part 5, and a grip part 6. These parts 3, 4, 5, and 6 are integrally formed. A yoke 7 made of a material different from that of the parts 3, 4, 5, and 6 is continuous with the racket frame 2 at the throat part 4. The part of the racket frame 2 consisting of the head part 3 and the yoke 7 is ring-shaped, thus surrounding the ball-hitting face F.

The racket frame 2 is composed of a hollow pipe made of a fiber reinforced resin. More specifically, the racket frame 2 is composed of a laminate of fiber reinforced prepregs containing an epoxy resin as the matrix resin and carbon fibers impregnated with the epoxy resin.

As shown in FIG. 3, supposing that the ball-hitting face 3 is regarded as a clock surface and that a top position thereof is regarded as 12 o'clock, glass fibers having a high specific gravity are collectively disposed at an outer side (side of racket frame where groove for string is disposed) of a region between 3 o'clock and 4 o'clock (between 8 o'clock and 9 o'clock) of the head part of the racket frame 2.

The length of the racket frame 2 from the top position of the head part 3 to the bottom position of the grip part 6 is set to the range from 673 mm to 706 mm. The length thereof is set to 698.5 mm in this embodiment. The weight of the racket frame 2 is set to not less than 250 g nor more than 350 g. The weight thereof is set to 250 g in this embodiment.

The position P (balance point) of the center of gravity of the racket frame 2 is spaced by 300 to 400 mm from the grip end. In this embodiment, the center of gravity of the racket frame 2 is spaced by 365 mm from the grip end.

The area of the ball-hitting face F surrounded with the head part 3 is set to the range from 61290 $mm^2$ to 83871 $mm^2$. In this embodiment, the area of the ball-hitting face F is set to 80645 $mm^2$.

The racket frame 2 is formed as described below. The fiber reinforced prepregs containing the carbon fibers are layered one upon another on the surface of an internal-pressure tube covering a mandrel to mold a laminate (layup) of the fiber reinforced prepregs. After the mandrel was removed from the layup, the layup is set in a molding die. After the molding die is clamped, the die is heated, with an air pressure kept applied to the inside of the inner-pressure tube.

Figure 4A:
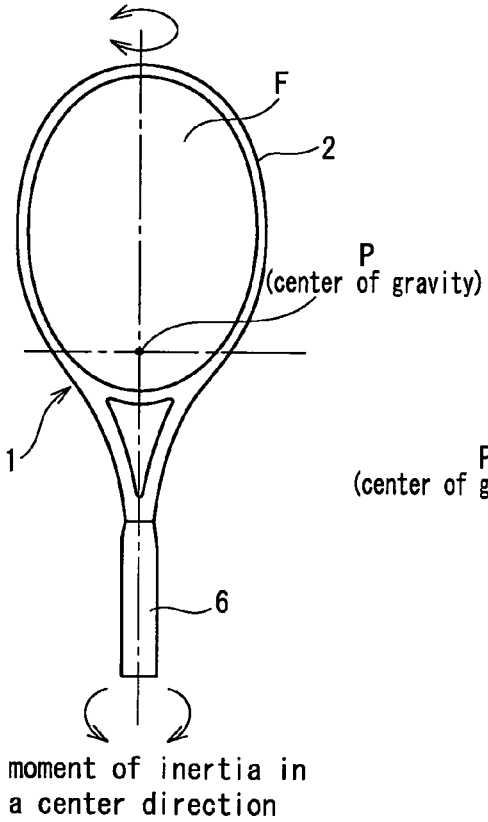
FIGS. 4A and 4B are an explanatory view respectively showing the moment of inertia in a center direction and the moment of inertia around the center of gravity direction to which attention is paid in the present invention.

When accessories (grommet, bumper, end cap, and grip leather) are mounted (strings are not mounted on the racket frame) on the tennis racket 2 formed in the above-described manner, the moment of inertia Ic thereof in the center direction thereof shown in FIG. 4A is set to not less than 13000 $g \cdot cm^2$ nor more than 17000 $g \cdot cm^2$. In this embodiment, the moment of inertia Ic of the tennis racket 2 in the center direction thereof is set to 16800 $g \cdot cm^2$.

Figure 4B:
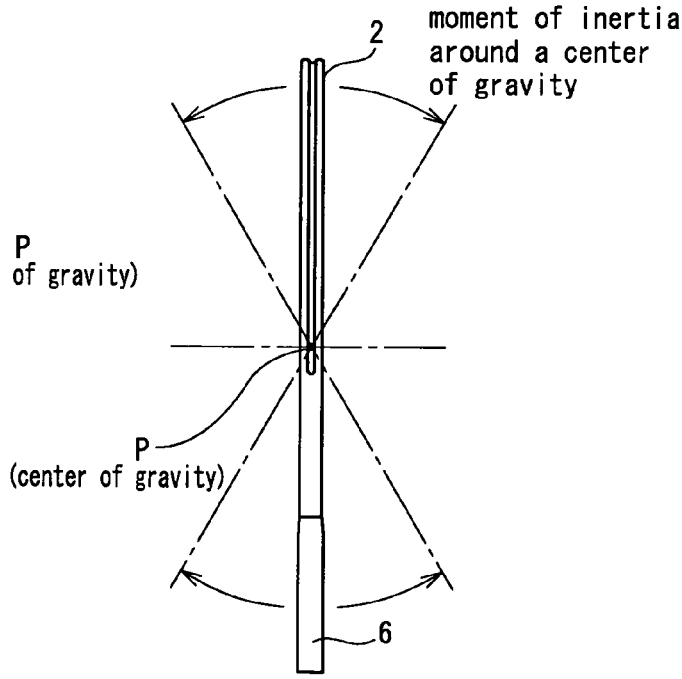

The moment of inertia Ig of the tennis racket 2 around the center of gravity thereof shown in FIG. 4B is set to not less than 80000 $g \cdot cm^2$ nor more than 200000 $g \cdot cm^2$. In this embodiment, the moment of inertia Ig of the tennis racket 2 around the center of gravity thereof is set to 87000 $g \cdot cm^2$. The moments of inertia Ic and Ig have a relationship expressed by $[30 \times (Ic) - (Ig)]/10000 \geqq 31$.

Figure 5A:
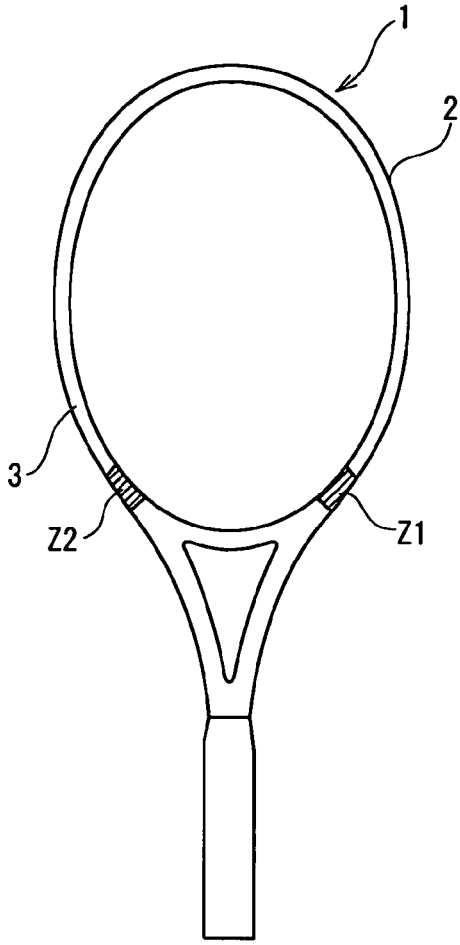
FIGS. 5A and 5B show a modification of the embodiment respectively shown in FIG. 2.
Figure 5B:
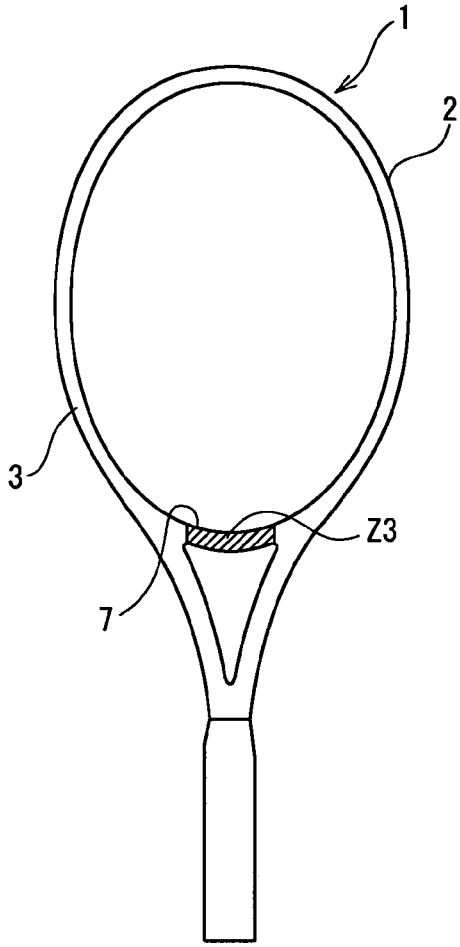

The present invention is not limited to the above-described embodiment. For example, instead of disposing a glass fiber having a high specific gravity in the region between 3 o'clock and 4 o'clock (between 9 o'clock and 8 o'clock) of the head part, it is possible to provide the racket frame with portions Z1 and Z2 at the position of 5 o'clock and 7 o'clock where the glass fiber having a high specific gravity is disposed, as shown in FIG. 5A or a portion Z3 at the yoke 7 where the glass fiber having a high specific gravity is disposed, as shown in FIG. 5B.

Figure 6A:
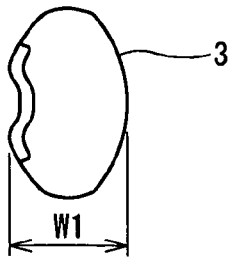
FIGS. 6A and 6B show another modification.
Figure 6B:
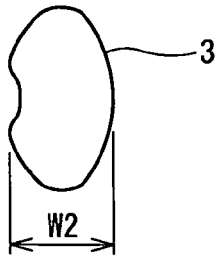

As shown in FIGS. 6A and 6B, it is also possible to make a sectional width W1 at the 5 o'clock (7 o'clock) position of the head part larger than a sectional width W2 of other portions of the head part.

In addition, the distribution of the weight of the racket frame or the configuration thereof may be optimized by using the above-described method.

Examples 1 through 6 of the tennis racket of the present invention and comparison examples 1 and 2 will be described below.

Method of Manufacturing Racket Frame

The racket frames of the tennis rackets of the examples and the comparison examples were manufactured by the following method:

Prepreg sheets (T300, 700, 800, M46J manufactured by Toray Industries Inc.) containing a fiber reinforced thermosetting resin were layered one upon another on a mandrel (ϕ14.5 mm) covered with an internal-pressure tube made of nylon 66. Thereby a cylindrical laminate was formed. The fibrous angles of the prepreg sheets were set to 0°, 22°, 30°, 45°, and 90°.

After the mandrel was removed from the laminate, the laminate was set in a molding die. After the die was clamped, the die was heated at 150° C. for 30 minutes, with an air pressure of 9 $kgf/cm^2$ kept applied to the inside of the inner-pressure tube.

The tennis racket of each of the examples and the comparison examples was constructed as described below. The moment of inertia Ic of each tennis racket in the center direction and the moment of inertia Ig of each tennis racket around the center of gravity thereof were set to the values shown in table 1.

The weight of the tennis racket, the position of the center of gravity thereof, and the moment of inertia thereof were measured when essential accessories such as a grommet, a bumper, an end cap, and grip leather which were mounted on the racket frame (string was not mounted thereon).

TABLE 1

| | | E1 | E2 | E3 | E4 | E5 | E6 | CE1 | CE2 |
|---|---|---|---|---|---|---|---|---|---|
| Weight (g) | | 250 | 265 | 255 | 300 | 280 | 250 | 295 | 270 |
| Balance (mm) | | 365 | 350 | 360 | 320 | 335 | 355 | 320 | 345 |
| Moment of inertia Ic in center direction ($g \cdot cm^2$) | | 16800 | 16600 | 15300 | 16500 | 15000 | 13500 | 14900 | 13500 |
| Moment of inertia around center of gravity ($g \cdot cm^2$) | | 87000 | 128000 | 90000 | 182000 | 140000 | 91000 | 178000 | 133000 |
| Value of [30 × (Ic) − (Ig)]/10000 | | 42 | 37 | 37 | 31 | 31 | 31 | 27 | 27 |
| Area of ball-hitting face (square inch) | | 125 | 125 | 115 | 125 | 110 | 105 | 110 | 105 |
| Evaluation by ball-hitting test | Operability (swinging motion) | 10 | 8 | 9 | 6 | 7 | 8 | 3 | 4 |
| | Stability of ball-hitting face | 10 | 10 | 8 | 10 | 8 | 5 | 5 | 4 |
| | Rebound performance | 7 | 7 | 6 | 10 | 8 | 5 | 9 | 6 |
| | Collective evaluation | 10 | 9 | 8 | 7 | 7 | 6 | 4 | 3 |

where E denotes example.
where CE denotes comparison example.

EXAMPLE 1

Five grams of a glass fiber (produced by Nittobou Inc., plain weave cloth, specific gravity: 2.54) was disposed collectively in a region between 3 o'clock and 4 o'clock (between 9 o'clock and 8 o'clock) of the head part. The moment of inertia and the like were set as follows:

Weight/balance: 250 g/365 mm

The area of the ball-hitting face: 125 square inches

The moment of inertia Ic in the center direction: 16800 $g \cdot cm^2$

The moment of inertia Ig around the center of gravity: 87000 $g \cdot cm^2$

The above "balance" is the dimension from the grip end to the center of gravity.

EXAMPLE 2

As in the case of the example 1, the same glass fiber as that of the example 1 was disposed collectively in the region between 3 o'clock and 4 o'clock (between 9 o'clock and 8 o'clock) of the head part. The moment of inertia and the like were set as follows:

Weight/balance: 265 g/350 mm

The area of the ball-hitting face: 125 square inches

The moment of inertia Ic in the center direction: 16600 $g \cdot cm^2$

The moment of inertia Ig around the center of gravity: 128000 $g \cdot cm^2$.

EXAMPLE 3

The same glass fiber as that of the example 1 was disposed collectively at the position of 4 o'clock (8 o'clock) of the head part. The moment of inertia and the like were set as follows:

Weight/balance: 255 g/360 mm

The area of the ball-hitting face: 115 square inches

The moment of inertia Ic in the center direction: 15300 $g \cdot cm^2$

The moment of inertia Ig around the center of gravity: 90000 $g \cdot cm^2$.

EXAMPLE 4

The same glass fiber as that of the example 1 was disposed collectively at the position of 3 o'clock (9 o'clock) of the head part. The moment of inertia and the like were set as follows:

Weight/balance: 300 g/320 mm

The area of the ball-hitting face: 125 square inches

The moment of inertia Ic in the center direction: 16500 $g \cdot cm^2$

The moment of inertia Ig around the center of gravity: 182000 $g \cdot cm^2$.

EXAMPLE 5

As in the case of the example 1, the same glass fiber as that of the example 1 was disposed collectively in the region between 3 o'clock and 4 o'clock (between 9 o'clock and 8 o'clock) of the head part. The moment of inertia and the like were set as follows:

Weight/balance: 280 g/335 mm

The area of the ball-hitting face: 110 square inches

The moment of inertia Ic in the center direction: 15000 $g \cdot cm^2$

The moment of inertia Ig around the center of gravity: 140000 $g \cdot cm^2$.

EXAMPLE 6

The same glass fiber as that of the example 1 was disposed collectively at the yoke. The moment of inertia and the like were set as follows:

Weight/balance: 250 g/355 mm

The area of the ball-hitting face: 105 square inches

The moment of inertia Ic in the center direction: 13500 $g \cdot cm^2$

The moment of inertia Ig around the center of gravity: 91000 $g \cdot cm^2$.

COMPARISON EXAMPLE 1

All parts of the racket frame were formed in the same lamination construction without concentrating a weight at a particular portion in the region between the top position of the head part and the grip. A carbon fiber and an epoxy resin were used. The moment of inertia and the like were set as follows:

Weight/balance: 295 g/320 mm

The area of the ball-hitting face: 110 square inches

The moment of inertia Ic in center direction: 14900 $g \cdot cm^2$

The moment of inertia Ig around the center of gravity: 178000 $g \cdot cm^2$.

COMPARISON EXAMPLE 2

As in the case of the comparison example 1, all parts of the racket frame were formed in the same lamination construction without concentrating a weight at a particular portion in the region between the top position of the head part and the grip. The carbon fiber and the epoxy resin were used. The moment of inertia and the like were set as follows:

Weight/balance: 270 g/345 mm

The area of the ball-hitting face: 105 square inches

The moment of inertia Ic in center direction: 13500 g·cm$^2$

The moment of inertia Ig around the center of gravity: 133000 g·cm$^2$.

The moment of inertia Ic of the racket frame of each of the examples 1 through 6 and the comparison examples 1 and 2 in the center direction thereof and the moment of inertia Ig thereof around the center of gravity thereof were measured by using a method described below.

Measurement of Moment of Inertia

Figure 7A:
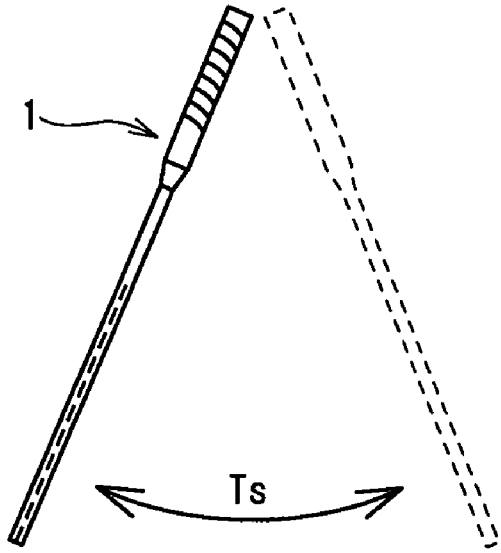
FIGS. 7A and 7B show the method of measuring the moment of inertia.

As shown in FIG. 7A, the tennis racket 1 of each of the examples and the comparison examples was hung, with the grip thereof located uppermost to measure a swing period Ts thereof by using a measuring instrument. The moment of inertia Is thereof in the swing direction (in out-of-plane direction around grip end) was computed by using the following equation.

Figure 7B:
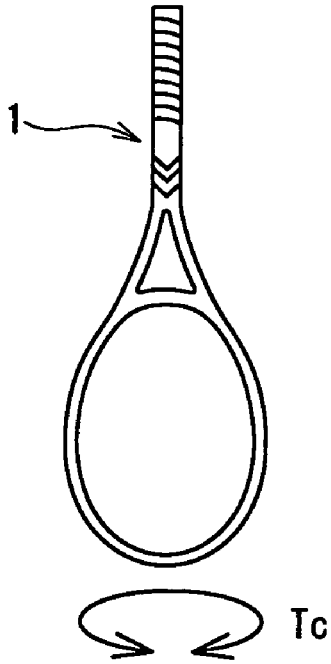
Figure 8A:
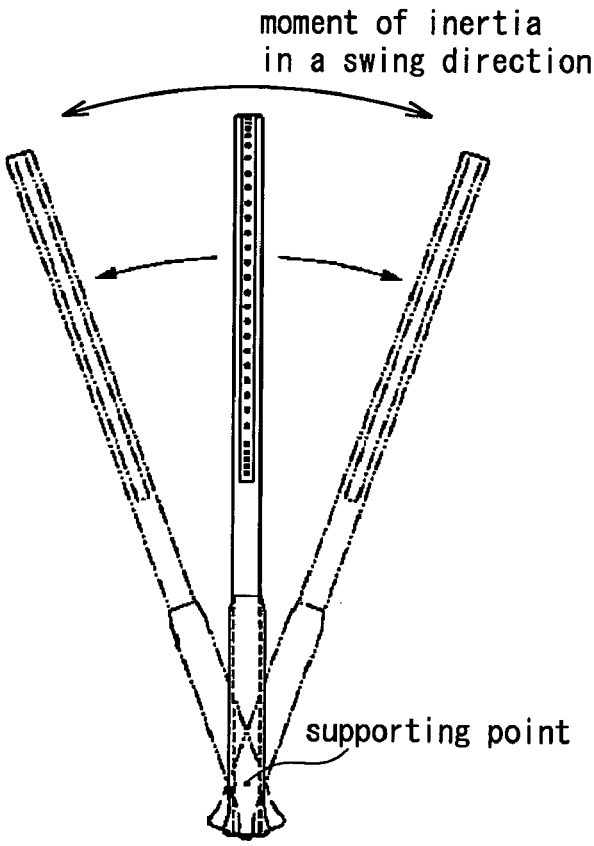
FIGS. 8A and 8B are an explanatory view respectively showing the moment of inertia in a center direction and the moment of inertia in a swing direction to which attention is paid in a conventional art.
Figure 8B:
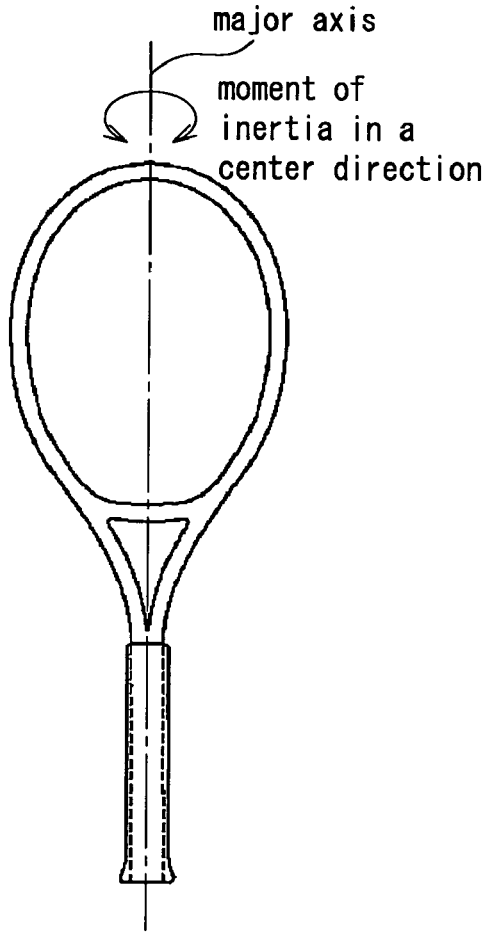
PRIOR ART Fig. 8B

As shown in FIG. 7B, each tennis racket was hung, with the grip thereof located uppermost to measure a center period Tc thereof by using a measuring instrument. The moment of inertia Ic around the axis of the grip part (moment of inertia in the center direction) thereof was computed by using the following equation.

Computation of Moment of Inertia

Swing direction (in out-of-plane direction around grip end): Is (g·cm$^2$)

$$Is=M\times g\times h(Ts/2/\pi)^2-Ic$$

Around the axis of the grip part (center direction): Ic (g·cm$^2$)

$$Ic=254458\times(Tc/\pi)^2-8357$$

Around the center of gravity: Ig $$Ig=Is-m(1+2.6)^2$$

Where M=m+mc, h=(m×1−mc×1c)/m+2.6, m: weight of tennis racket, 1: balance point of tennis racket, mc: weight of chuck, 1c: balance point of chuck.

Figure 1:
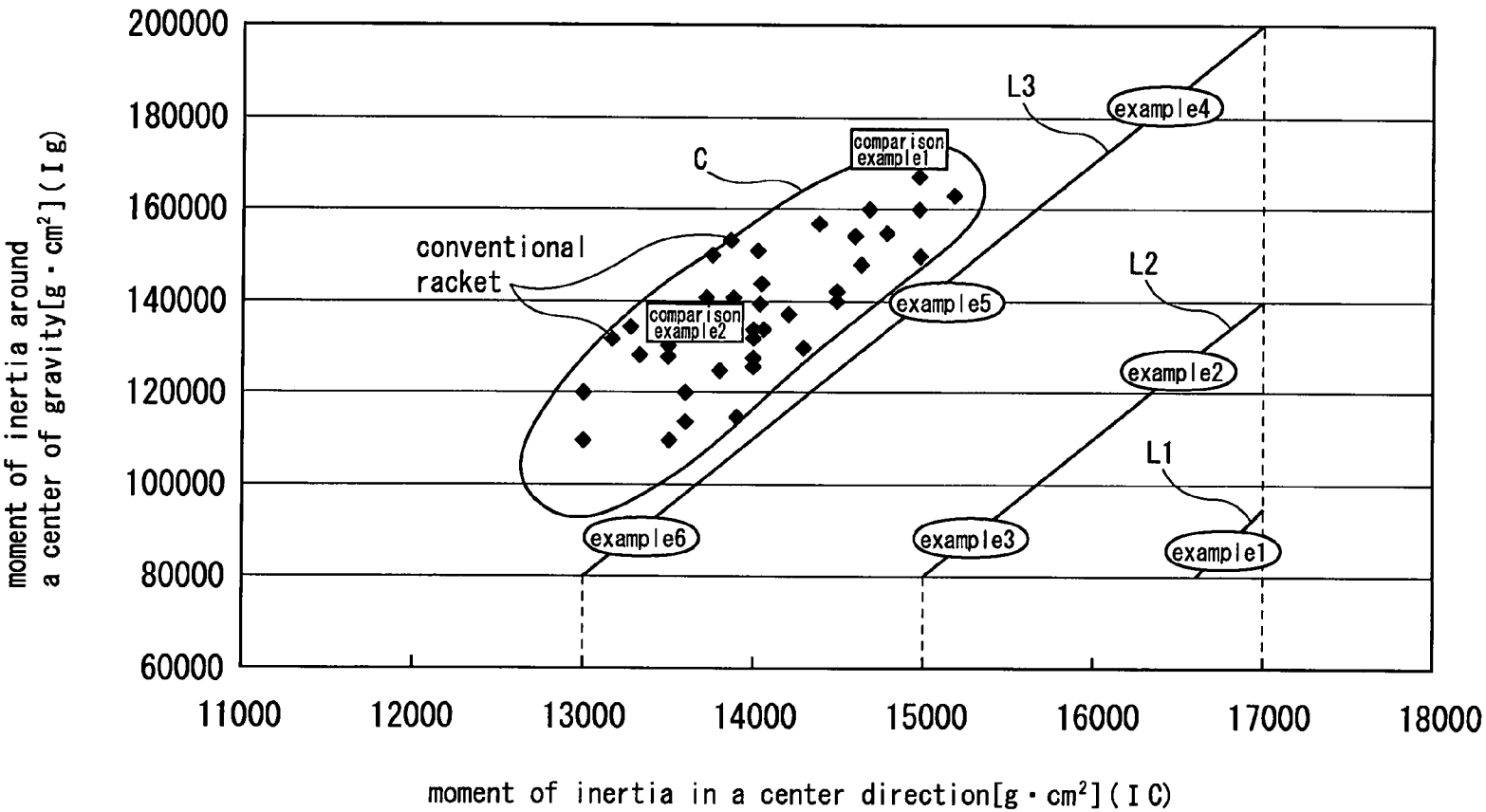
FIG. 1 is a graph showing the moment of inertia of a tennis racket of the present invention and that of a conventional tennis racket.

FIG. 1 shows the relationship between the moment of inertia Ic of each tennis racket in the center direction thereof and the moment of inertia Ig thereof around the center of gravity thereof.

The tennis racket of each of the comparison examples 1 and 2 was positioned inside a region C of FIG. 1 where conventional tennis rackets were disposed. The moment of inertia Ig of the tennis racket of each of the comparison examples 1 and 2 around the center of gravity thereof increased with an increase of the moment of inertia Ic thereof in the center direction.

On the other hand, the tennis racket of the example 1 had the largest center-direction moment of inertia Ic of all the tennis rackets of the examples 1 through 6 and the comparison examples 1 and 2, whereas the tennis racket of the example 1 had the smallest moment of inertia Ig around the center of gravity thereof of all the tennis rackets of the examples 1 through 6 and the comparison examples 1 and 2. The moment of inertia Ic of the tennis racket of the example 6 in the center direction thereof was equal to the moment of inertia Ic of the tennis racket of the comparison example 2 in the center direction thereof, whereas the moment of inertia Ig of the tennis racket of the example 6 around its center of gravity thereof was smaller by 42000 g·cm$^2$ than the moment of inertia Ig of the comparison example 2 around its center of gravity.

As apparent from the above description, the moments of inertia Ic of the tennis rackets of the examples in the center direction thereof are set large to make the ball-hitting face stable so that the ball-hitting face is prevented from deviating. In addition, the moments of inertia Ig thereof around the center of gravity thereof were set small to make the operability thereof high to allow the tennis racket to be swung easily.

Examining the moments of inertia Ic and Ig of the tennis rackets of the examples 1 through 5, the moments of inertia Ic of the tennis rackets of the examples 1 through 6 in the center direction thereof are in the following order: example 1>example 2>example 4>example 3>example 5>example 6. The moment of inertia Ig of the tennis rackets of the examples 1 through 6 around the center of gravity thereof are in the following order: example 4>example 5>example 2>example 3 and 6>example 1. As shown in FIG. 1, the tennis rackets of examples 4, 5, and 6 are on a line L3. The tennis rackets of examples 2 and 3 are on a line L2. The tennis racket of the example 1 is on a line L1.

More specifically, the tennis rackets of the examples 4, 5, and 6 are positioned on the line (straight line shown with solid line L3 in FIG. 1) of [30×(Ic)−(Ig)]/10000=30. The tennis rackets of the examples 2 and 3 are positioned on the line (straight line shown with solid line L2 in FIG. 1) of [30×(Ic)−(Ig)]/10000=37. The tennis racket of the example 1 is positioned on the line (straight line shown with solid line L1 in FIG. 1) of [30×(Ic)−(Ig)]/10000=42. The tennis rackets of the examples 4, 5, and 6 in which the relationship between the moments of inertia Ic and Ig is positioned on the line L3 of [30×(Ic)−(Ig)]/10000=30 are superior in the collective performance thereof to the tennis rackets of the comparison examples 1 and 2 in which the relationship between the moments of inertia Ic and Ig [30×(Ic)−(Ig)]/10000 is less than 30. The tennis rackets of the examples 2 and 3 in which the relationship between the moments of inertia Ic and Ig is positioned on the line L2 of [30×(Ic)−(Ig)]/10000=37 are superior to the tennis rackets of the examples 4, 5, and 6 in the collective performance thereof. The tennis racket of the example 1 in which the relationship between the moments of inertia Ic and Ig is positioned on the line L1 of [30×(Ic)−(Ig)]/10000=42 is superior to the tennis rackets of the examples 2 and 3 in the collective performance thereof. Thereby it can be confirmed that it is possible to obtain a tennis racket having excellent performance when the relationship expressed by [30×(Ic)−(Ig)]/10000 is not less than 31, and more favorably not less than 37, and most favorably not less than 42.

Unlike the conventional tennis racket, the moments of inertia Ic and Ig of the tennis racket of the present invention are not proportional to each other. The present invention provides the tennis racket having excellent performance because the moments of inertia Ic and Ig are so set that the relationship expressed by [30×(Ic)−(Ig)]/10000≧31 is satisfied.

Evaluation of Tennis Racket by Ball-Hitting Test

To examine the rebound performance, operability, and ball-hitting face stability of each tennis racket, a questionnaire was conducted by requesting 50 middle and high class players (who satisfied the condition that they have more than 10 years' experience of tennis and play tennis three or more days a week currently) to hit tennis balls therewith. These performances were evaluated on the basis of 10 points (the more, the better). Table 1 shows the average of marks given by them.

As shown in table 1, the tennis rackets of the examples 1 through 6 were superior to those of the comparison examples 1 and 2 in the evaluation of the operability (swinging motion), the ball-hitting face stability, the rebound performance, and the collective evaluation. The collective evaluation of the comparison examples 1 and 2 was four points and three points respectively.

In the comparison among the tennis rackets of the examples 1 through 6, the tennis rackets of the examples 4, 5, and 6 having the above-described relationship, positioned on the line L3, similar to that of the conventional tennis racket were given six to seven points in the collective evaluation. On the other hand, the tennis rackets of the examples 1, 2, and 3 having the above-described relationship different from that of the conventional tennis racket were given 10 to eight points in the collective evaluation.

As described above, in addition to the moment of inertia in the center direction, the tennis racket of the present invention is designed based not on the moment of inertia in the swing direction around its grip end, but on the moment of inertia around the center of gravity thereof. Thereby it is possible to improve the operability (swinging motion), ball-hitting face stability, and rebound performance of the tennis racket in a favorable balance. Thus the tennis racket of the present invention is preferably applicable to softball tennis in addition to regulation-ball tennis. Based on the above-described technical idea, the tennis racket is also applicable to squash, badminton, and the like.

What is claimed is:

1. A tennis racket comprising a racket frame composed of a fiber reinforced resin, wherein a moment of inertia Ic of said tennis racket in a center direction thereof is set to not less than 13000 $g \cdot cm^2$ nor more than 17000 $g \cdot cm^2$; a moment of inertia Ig thereof around a center of gravity thereof is set to not less than 80000 $g \cdot cm^2$ nor more than 200000 $g \cdot cm^2$; and said moments of inertia Ic and Ig are so set as to satisfy a relationship expressed by $[30 \times (Ic) - (Ig)]/10000 \geqq 31$.

2. The tennis racket according to claim 1, wherein said moment of inertia Ic in said center direction is set to not less than 15000 $g \cdot cm^2$; said moment of inertia Ig around said center of gravity is set to not more than 140000 $g \cdot cm^2$; and $[30 \times (Ic) - (Ig)]/10000 \geqq 37$.

3. The tennis racket according to claim 2, wherein a whole length of said tennis racket is set to a range from 673 mm to 706 mm; a distance from a grip end of said tennis racket to said center of gravity thereof is set to 300 mm to 400 mm; and a weight of a racket frame is set to not less than 250 g.

4. The tennis racket according to claim 2, wherein supposing that a ball-hitting face of said racket frame is regarded as a clock surface, glass fibers having a high specific gravity are collectively disposed in a range of three o'clock and four o'clock (eight o'clock and nine o'clock) or/and a yoke.

5. The tennis racket according to claim 1, wherein a whole length of said tennis racket is set to a range from 673 mm to 706 mm; a distance from a grip end of said tennis racket to said center of gravity thereof is set to 300 mm to 400 mm; and a weight of a racket frame is set to not less than 250 g.

6. The tennis racket according to claim 5, wherein supposing that a ball-hitting face of said racket frame is regarded as a clock surface, glass fibers having a high specific gravity are collectively disposed in a range of three o'clock and four o'clock (eight o'clock and nine o'clock) or/and a yoke.

7. The tennis racket according to claim 1, wherein supposing that a ball-hitting face of said racket frame is regarded as a clock surface, glass fibers having a high specific gravity are collectively disposed in a range of three o'clock and four o'clock (eight o'clock and nine o'clock) or/and a yoke.

* * * * *